US010946509B2

(12) United States Patent
Mascall

(10) Patent No.: US 10,946,509 B2
(45) Date of Patent: Mar. 16, 2021

(54) HAND-HELD POWER TOOL AND CONTROL METHOD

(71) Applicant: Hilti Aktiengesellschaft, Schaan (LI)

(72) Inventor: Eric Mascall, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 155 days.

(21) Appl. No.: 15/759,099

(22) PCT Filed: Sep. 6, 2016

(86) PCT No.: PCT/EP2016/070919
§ 371 (c)(1),
(2) Date: Mar. 9, 2018

(87) PCT Pub. No.: WO2017/042144
PCT Pub. Date: Mar. 16, 2017

(65) Prior Publication Data

US 2018/0311806 A1 Nov. 1, 2018

(30) Foreign Application Priority Data

Sep. 10, 2015 (EP) ..... 15184693

(51) Int. Cl.
*B25F 5/00* (2006.01)

(52) U.S. Cl.
CPC ..... *B25F 5/008* (2013.01); *B25F 5/001* (2013.01)

(58) Field of Classification Search
CPC ..... B25F 5/008
USPC ..... 173/117
See application file for complete search history.

(56) References Cited

U.S. PATENT DOCUMENTS

| | | | | |
|---|---|---|---|---|
| 8,334,626 | B2 | 12/2012 | Lange et al. | |
| 8,513,838 | B2 | 8/2013 | Toukairin et al. | |
| 2009/0103263 | A1* | 4/2009 | Fuchs | B25F 5/008 361/695 |
| 2009/0302695 | A1 | 12/2009 | Kawamura et al. | |
| 2010/0102654 | A1* | 4/2010 | Lange | B25F 5/008 310/62 |

(Continued)

FOREIGN PATENT DOCUMENTS

| | | | |
|---|---|---|---|
| CN | 101263643 | A | 9/2008 |
| CN | 102284929 | A | 12/2011 |

(Continued)

OTHER PUBLICATIONS

PCT/EP2016/070919, International Search Report (PCT/ISA/220 and PCT/ISA/210) dated Nov. 8, 2016, with partial English translation, enclosing Written Opinion of the International Searching Authority (PCT/ISA/237) (Fourteen (14) pages).

*Primary Examiner* — Anna K Kinsaul
*Assistant Examiner* — Chinyere J Rushing-Tucker
(74) *Attorney, Agent, or Firm* — Crowell & Moring LLP

(57) ABSTRACT

A control method for a hand-held power tool includes measuring a temperature of an electric motor, opening a switchable clutch if the temperature exceeds a first threshold value, and energizing the electric motor when the clutch is open until the temperature falls below a second threshold value. In an embodiment, the electric motor is switched to a current-free mode, i.e., switched off, if the temperature falls below the second threshold value. The second threshold value is preferably less than the first threshold value.

6 Claims, 1 Drawing Sheet

(56) References Cited

U.S. PATENT DOCUMENTS

| | | | | |
|---|---|---|---|---|
| 2011/0180286 | A1* | 7/2011 | Oomori | B25F 5/008 173/20 |
| 2011/0303718 | A1* | 12/2011 | Spasov | B25C 1/06 227/2 |
| 2011/0303730 | A1 | 12/2011 | Blessing et al. | |
| 2012/0279736 | A1* | 11/2012 | Tanimoto | B25B 23/1475 173/2 |
| 2013/0021783 | A1* | 1/2013 | Vanko | B25F 5/00 362/119 |
| 2013/0025892 | A1* | 1/2013 | Mashiko | B25B 21/02 173/2 |
| 2013/0284475 | A1* | 10/2013 | Hirabayashi | B25F 5/008 173/47 |
| 2013/0300331 | A1* | 11/2013 | Nishii | H02P 29/68 318/471 |
| 2014/0242887 | A1* | 8/2014 | Schuele | B23Q 11/127 451/358 |
| 2019/0255690 | A1* | 8/2019 | Kondou | H02K 9/06 |

FOREIGN PATENT DOCUMENTS

| | | | |
|---|---|---|---|
| CN | 102284947 | A | 12/2011 |
| EP | 2 251 148 | A1 | 11/2010 |
| EP | 2 662 187 | A2 | 11/2013 |
| JP | 11-42570 | A | 2/1999 |
| JP | 2009-56556 | A | 3/2009 |
| JP | 5472683 | B2 | 4/2014 |
| WO | WO 2009/145206 | A2 | 12/2009 |

* cited by examiner

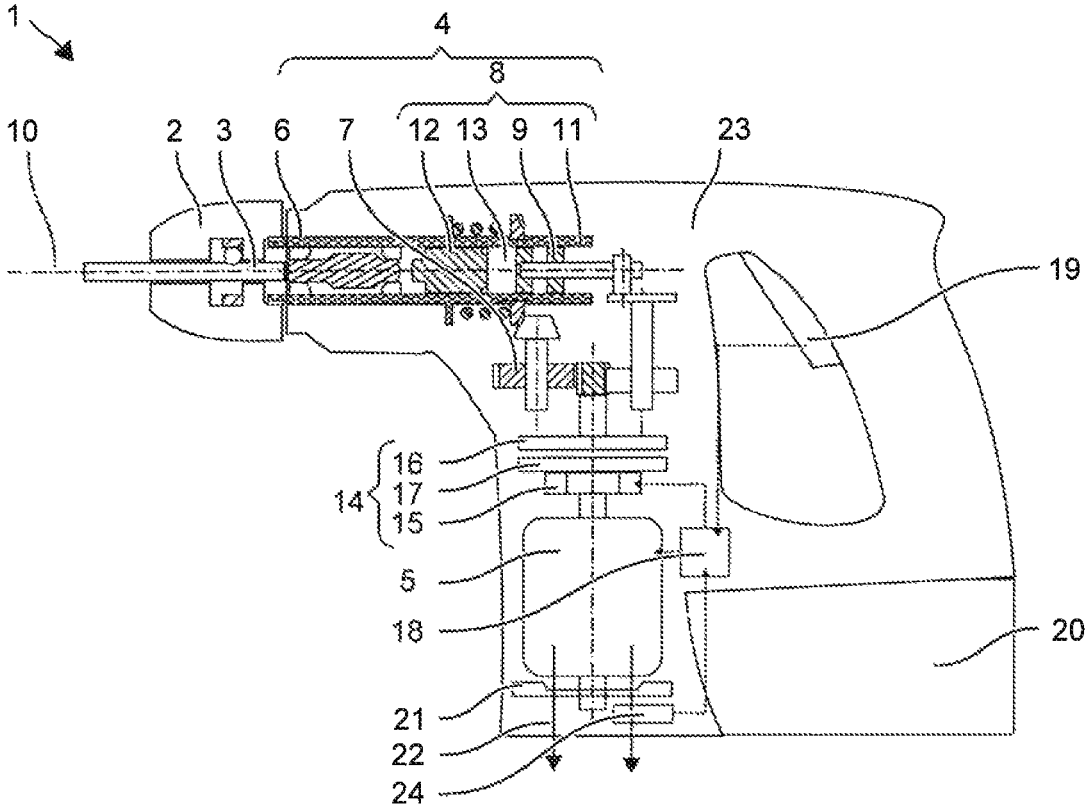
1
4
8
10
2
3
6
7
12
13
9
11
23
19
16
17
14
15
5
18
20
21
22
24

HAND-HELD POWER TOOL AND CONTROL METHOD

This application claims the priority of International Application No. PCT/EP2016/070919, filed Sep. 6, 2016, and European Patent Document No. 15184693.8, filed Sep. 10, 2015, the disclosures of which are expressly incorporated by reference herein.

BACKGROUND AND SUMMARY OF THE INVENTION

The present invention relates to a hand-held power tool with an electric motor and a control method for the power tool.

A hand-held power tool can be used with high load for a long time. In this case, the electric motor and the drive train heats up so much that damage or high wear of the power tool is to be expected. A protective measure is to switch off the power tool.

The hand-held power tool of the invention has a tool holder for holding a tool on a working axis, an electric motor for driving the tool holder, a temperature sensor for detecting the temperature of the electric motor and a fan coupled to the electric motor. An electrically controlled clutch is disposed in the drive train between the tool holder and the electric motor. A motor controller responds to the exceeding of a first threshold by the measured temperature triggering an opening of the clutch. The motor controller energizes the electric motor with the clutch open until the temperature falls below a second threshold.

The hand-held power tool according to the invention does not switch off the electric motor after a thermal overload, but allows it to continue running. Parts or all driven components of the power tool, such as the tool holder, a striking tool, are decoupled thereby. The electric motor can drive the fan and cool the power tool quickly.

The control method according to the invention for the power tool includes the following steps: measuring the temperature of the electric motor; opening the switchable clutch when the temperature exceeds a first threshold; and energizing the electric motor with the clutch open until the temperature drops below the second threshold. In one embodiment, the electric motor is switched to a current-free mode, i.e., switched off, when the temperature falls below the second threshold. The second threshold is preferably less than the first threshold.

The following description illustrates the invention by way of exemplary embodiments and the FIGURE.

BRIEF DESCRIPTION OF THE DRAWING

The FIGURE illustrates a hammer drill.

DETAILED DESCRIPTION OF THE DRAWING

Identical or functionally similar elements are indicated by like reference numerals in the FIGURE, unless otherwise stated.

The FIGURE shows a hammer drill 1 as an example of electric hand-held power tools. Other hand-held power tools may be electric screwdrivers, circular saws, jigsaws, angle grinders, etc. The hammer drill 1 has a tool holder 2, in which a drill or similar tool 3 can be used and locked. The tool holder 2 is coupled via a drive train 4 with an electric motor 5. The drive train 4 includes an output shaft 6, which transmits the torque of the electric motor 5 to the tool holder 2. A gearbox 7 can increase the torque.

The drive train 4 may further include a striking mechanism 8, in particular a pneumatic impact mechanism 8, which periodically exerts blows on the tool held in the tool holder 2. The exemplary pneumatic impact mechanism 8 has an exciter piston 9 which is moved back and forth by the electric motor 5 along a working axis 10 in a guide tube 11. A piston-shaped striker 12 also arranged in the guide tube 11 is coupled by an air spring to the exciter piston 9. The air spring is formed by a closed pneumatic chamber 13 closed off by the exciter piston 9 and striker 12.

A switchable clutch 14 is arranged in the drive train 4. The clutch 14 can be opened and closed by an electrical control signal. An exemplary clutch 14 has a solenoid 15 which, when energized, keeps a driving clutch plate 16 and a driven clutch plate 17 in contact. The control signal switches the current flow on or off.

The switchable clutch can also be mechanically, pneumatically or hydraulically switchable. A corresponding actuator can convert the electrical control signal into the mechanical, pneumatic or hydraulic action for switching the clutch 14.

The switchable clutch 14 is arranged in the drive train 4 between the output shaft 6 and the electric motor 5. The opened clutch 14 separates the tool holder 2 from the electric motor 5, so that the tool holder 2 does not rotate despite the electric motor 5 running. Preferably, the switchable clutch 14 may be arranged in the drive train 4 in front of the striking mechanism 8 in order to deactivate these when the clutch 14 is open.

The electric motor 5 is driven by a motor controller 18. Actuation of the power switch 19 by the user is detected by the motor controller 18. The motor controller 18 energizes the electric motor 5 in response to the actuation. The power supply is fed, for example, by a battery pack 20 or by a mains connection. The power switch 19 is preferably switched off automatically. The user must keep the power switch 19 actuated permanently to keep the hammer drill 1 in operation. Upon release of the power switch 19, the power switch 19 changes to the off position. As a rule, the motor controller 18 separates the electric motor 5 from the power supply in response to the power switch 19 being in the switch-off position. For example, the power switch 19 has an internal spring that places the power switch 19 in the off position by default. The power switch 19 may be a simple on/off switch. Preferably, the power switch 19 detects an actuation movement or an actuating force. The power switch 19 provides a variable setpoint for the average current of the electric motor 5. The motor controller 18 controls the average current in response to the setpoint. The user can thus influence the speed of the electric motor 5 by pressing with different intensities. The power switch 19 has, for example, a potentiometer formed by slider tracks as a switching contact.

The hammer drill 1 includes a fan 21, which cools the electric motor 5 and preferably the drive train 4. The fan 21 may be disposed on the rotor shaft of the electric motor 5. The fan 21 can, for example, be arranged downstream of the electric motor 5, suck a stream of air 22 from the electric motor 5 and blow it out of the machine housing 23.

A temperature sensor 24 monitors the temperature of the electric motor 5. The temperature sensor 24 may be arranged directly on the electric motor 5 or be arranged, for example, in an exhaust air flow of the hammer drill 1. The engine controller 18 monitors the measured temperature. If the temperature exceeds a threshold value, the power consumption of the electric motor 5 is limited. The motor controller 18, for example, reduces the average current compared to the predetermined power switch 19 setpoint. If the temperature exceeds a critical threshold, the engine controller 18 opens the clutch 14. The electric motor 5 is thus switched to be load-free. The motor controller 18 continues to energize the electric motor 5, so that this rotates and drives the fan 21. The average current for this cooling mode is adapted to the missing load. The fan 21 preferably rotates at a constant speed, which allows a maximum cooling rate. The cooling mode continues until the temperature is sufficiently lowered. The temperature to be reached is preferably less than the critical threshold, for example lower by 2° C. (degrees Celsius) to 10° C.

The user perceives the disconnection of the drive train 4 and will typically release the power switch 19. The motor controller 18 initially ignores the power switch 19, although this changes to the off position. As long as the temperature is greater than the temperature to be reached, the electric motor 5 remains energized and drives the fan 21. The motor controller 18 turns off the electric motor 5 when the temperature falls below the temperature to be reached.

The invention claimed is:

1. A hand-held power tool, comprising:

a tool holder for holding a tool on a work shaft;

an electric motor, wherein the electric motor drives the tool holder via a switchable clutch disposed in a drive train between the tool holder and the electric motor;

a temperature sensor, wherein a temperature of the electric motor is measurable by the temperature sensor;

a fan wheel coupled to the electric motor; and a motor controller, wherein the motor controller triggers an opening of the switchable clutch when a first measured temperature of the electric motor exceeds a first threshold value, energizes the electric motor when the switchable clutch is open until a second measured temperature of the electric motor falls below a second threshold, and switches the electric motor to a non-powered state when the second measured temperature falls below the second threshold.

2. The hand-held power tool according to claim 1, further comprising a power switch for switching the electric motor on and off, wherein the motor controller energizes the electric motor when the switchable clutch is open with the power switch in an off position.

3. A control method for a hand-held power tool wherein the hand-held power tool comprises:

a tool holder for holding a tool on a work shaft;

an electric motor, wherein the electric motor drives the tool holder via a switchable clutch disposed in a drive train between the tool holder and the electric motor;

a temperature sensor, wherein a temperature of the electric motor is measurable by the temperature sensor; and a fan wheel coupled to the electric motor;

and comprising the steps of:

measuring the temperature of the electric motor;

opening the switchable clutch when a first measured temperature of the electric motor exceeds a first threshold;

energizing the electric motor when the switchable clutch is open until a second measured temperature of the electric motor falls below a second threshold; and switching the electric motor to a non-powered state when the second measured temperature falls below the second threshold.

4. The control method according to claim 3, wherein the second threshold is between 2° C. and 10° C. below the first threshold.

5. A control method for a hand-held power tool wherein the hand-held power tool comprises:

a tool holder for holding a tool on a work shaft;

an electric motor, wherein the electric motor drives the tool holder via a switchable clutch disposed in a drive train between the tool holder and the electric motor;

a temperature sensor, wherein a temperature of the electric motor is measurable by the temperature sensor; and a fan wheel coupled to the electric motor;

and comprising the steps of:

measuring the temperature of the electric motor;

opening the switchable clutch when a first measured temperature of the electric motor exceeds a first threshold;

energizing the electric motor when the switchable clutch is open until a second measured temperature of the electric motor falls below a second threshold; and detecting a release of a power switch by a user of the hand-held power tool and, in response to the release, deenergizing the electric motor only when a measured temperature of the electric motor is less than the first threshold.

6. The control method according to claim 5, wherein the second threshold is between 2° C. and 10° C. below the first threshold.

* * * * *